US006701304B2

(12) United States Patent
Leon

(10) Patent No.: US 6,701,304 B2
(45) Date of Patent: Mar. 2, 2004

(54) METHOD AND APPARATUS FOR POSTAGE LABEL AUTHENTICATION

(75) Inventor: JP Leon, San Carlos, CA (US)

(73) Assignee: Neopost Inc., Hayward, CA (US)

( * ) Notice: Subject to any disclaimer, the term of this patent is extended or adjusted under 35 U.S.C. 154(b) by 0 days.

(21) Appl. No.: 09/358,801

(22) Filed: Jul. 21, 1999

(65) Prior Publication Data

US 2003/0028497 A1 Feb. 6, 2003

Related U.S. Application Data

(63) Continuation of application No. 09/250,990, filed on Feb. 16, 1999.

(60) Provisional application No. 60/093,849, filed on Jul. 22, 1998, provisional application No. 60/094,065, filed on Jul. 24, 1998, provisional application No. 60/094,073, filed on Jul. 24, 1998, provisional application No. 60/094,116, filed on Jul. 24, 1998, provisional application No. 60/094,120, filed on Jul. 24, 1998, provisional application No. 60/094,122, filed on Jul. 24, 1998, and provisional application No. 60/094,127, filed on Jul. 24, 1998.

(51) Int. Cl.[7] ..... G07B 17/60

(52) U.S. Cl. ..... 705/401; 705/60; 705/410

(58) Field of Search ..... 705/40, 408, 401; 252/301.35; 235/495; 380/51

(56) References Cited

U.S. PATENT DOCUMENTS

| | | | | |
|---|---|---|---|---|
| 3,928,226 A | * | 12/1975 | McDonough et al. | 106/31.64 |
| 4,053,433 A | * | 10/1977 | Lee | 252/408.1 |
| 4,447,890 A | | 5/1984 | Duwel et al. | |

(List continued on next page.)

FOREIGN PATENT DOCUMENTS

| | | | | |
|---|---|---|---|---|
| EP | 825 565 A2 | | 2/1998 | |
| EP | 845 762 A2 | | 6/1998 | |
| GB | 1 536 403 | | 12/1978 | |
| GB | 0 856 816 A2 | * | 1/1997 | ..... G07B/17/00 |
| WO | WO 98/13790 A1 | | 4/1998 | |
| WO | WO 98/20461 A2 | | 5/1998 | |
| WO | WO 99/66456 | * | 12/1999 | ..... G07B/17/00 |
| WO | WO 00/49580 A1 | | 8/2000 | |

OTHER PUBLICATIONS

Webster'll New College Dictionary , Published by Houghton Mifflin Company, copyright 1999.*

Peter Johnston, Printers add mailing service, Graphic Arts Monthly, v66, n1, p54 (2) Jan. 1994, ISSN: 1047–9325.*

"Information–Based Indicia Program (IBIP), Performance Criteria for Information–Based Indicia and Security Architecture for Closed IBI Postage Metering Systems (PCIBI–C)" Jan. 12, 1999, United States Postal Service, dated Jan. 12, 1999.

(List continued on next page.)

*Primary Examiner*—James P. Trammell
*Assistant Examiner*—Daniel L. Greene
(74) *Attorney, Agent, or Firm*—Townsend and Townsend and Crew LLP

(57) ABSTRACT

A postage metering system that includes a secure metering device (SMD) coupled to a printer. The SMD generates an indicium and the printer receives and prints the indicium onto a label. The printed indicium label includes a human-readable portion, a machine-readable portion, and an identifier portion. The human-readable portion includes at least one data element, with each data element providing a particular postage information. The machine-readable portion includes a combination of one or more graphical representations and encoded texts. The identifier portion exhibits characteristics useful for authenticating the indicium label and can include a fluorescent strip, a micro printing portion, taggants, other identifiers, or a combination thereof.

36 Claims, 8 Drawing Sheets

U.S. PATENT DOCUMENTS 4,657,697 A 4/1987 Chiang
4,725,718 A * 2/1988 Sansone et al. ..... 235/375
4,743,747 A * 5/1988 Fougere et al. ..... 235/375
4,757,537 A 7/1988 Edelmann et al.
4,775,246 A 10/1988 Edelmann et al.
4,812,994 A 3/1989 Taylor et al.
4,813,912 A 3/1989 Chickneas et al.
4,831,555 A 5/1989 Sansone et al.
4,853,865 A 8/1989 Sansone et al.
4,853,961 A 8/1989 Pastor
4,949,381 A 8/1990 Pastor
5,142,577 A 8/1992 Pastor
5,181,245 A 1/1993 Jones
5,208,630 A * 5/1993 Goodbrand et al. ..... 283/73
5,231,668 A 7/1993 Kravitz
5,280,531 A 1/1994 Hunter
5,377,268 A 12/1994 Hunter
5,448,641 A 9/1995 Pintsov et al.
5,497,140 A 3/1996 Tuttle ..... 342/51
5,554,842 A * 9/1996 Connell et al. ..... 106/31.32
5,625,694 A 4/1997 Lee et al.
5,638,442 A 6/1997 Gargiulo et al.
5,666,421 A 9/1997 Pastor et al.
5,688,056 A 11/1997 Peyret
5,715,164 A 2/1998 Liechti et al.
5,742,683 A 4/1998 Lee et al.
5,781,438 A 7/1998 Lee et al.
5,793,867 A 8/1998 Cordery et al.
5,819,240 A * 10/1998 Kara ..... 700/235
5,822,738 A 10/1998 Shah et al.
5,920,850 A 7/1999 Hunter et al.
5,963,928 A 10/1999 Lee
6,125,357 A * 9/2000 Pintsov ..... 380/51
6,240,403 B1 * 5/2001 Shah et al. ..... 705/40
6,317,498 B1 * 11/2001 Pastor et al. ..... 380/51

OTHER PUBLICATIONS

"Information Based Indicia Program (IBIP) Indicium Specification," United States Postal Service, dated Jun. 13, 1996.

Information Based Indicia Program Postal Security Device Specification, United States Postal Service, dated Jun. 13, 1996.

"Information Based Indicia Program Host System Specification [Draft]," United States Postal Service, dated Oct. 9, 1996.

"Information–Based Indicia Program (IBIP), Performance Criteria for Information–Based Indicia and Security Architecture for IBI Postage Metering Systems (PCIBISAIBI-PMS)," United States Postal Service, dated Aug. 19, 1998.

United States Postal Service, "Performance Criteria For Information–Based Indicia And Security Architecture For Open IBI Postage Evidencing Systems," Information Based Indicia Program (IBIP), Jun. 25, 1999 XP–002161216.

Barker–Benfield, "First Union Offers Online Transactions," *Florida Times–Union*, Jan. 28, 1994.

FIBS PUB 140–1, Federal Information Processing Standards Publication, (Jan. 11, 1994) Security Requirements for Cryptographic Modules, U.S. Department of Commerce, Ronald H. Brown, Secretary, National Institute of Standards and Technology; pp:1–51.

* cited by examiner

METHOD AND APPARATUS FOR POSTAGE LABEL AUTHENTICATION

This application claims priority from the following U.S. provisional and non-provisional applications, the disclosures of which, including software appendices and all attached documents, are incorporated by reference in their entirety for all purposes:

Application Serial No. 60/093,849, entitled "Method and Apparatus for Postage Label Authentication," filed Jul. 22, 1998, of J P Leon and David A. Coolidge;

Application Serial No. 60/094,065, entitled "Method and Apparatus for Resetting Postage Meter," filed Jul. 24, 1998, of J P Leon;

Application Serial No. 60/094,073, entitled "Method, Apparatus, and Code for Maintaining Secure Postage Information," filed Jul. 24, 1998, of J P Leon, Albert L. Pion, and Elizabeth A. Simon;

Application Serial No. 60/094,116, entitled "Method and Apparatus for Dockable Secure Metering Device," filed Jul. 24, 1998, of J P Leon;

Application Serial No. 60/094,120, entitled "Method and Apparatus for Remotely Printing Postage Indicia," filed Jul. 24, 1998, of Chandrakant J. Shah, J P Leon, and David A. Coolidge;

Application Serial No. 60/094,122, entitled "Postage Metering System Employing Positional Information," filed Jul. 24, 1998, of J P Leon;

Application Serial No. 60/094,127, entitled "Method and Apparatus for Operating a Removable Secure Metering Device," filed Jul. 24, 1998, of J P Leon; and a continuation of Application Ser. No. 09/250,990, entitled "Postage Meter System," filed Feb. 16, 1999, of J P Leon.

The following related U.S. patent applications filed on the same day herewith are hereby incorporated by reference in their entirety for all purposes:

Application Ser. No. 09/359,158, now U.S. Pat. No. 6,341,274, entitled "Method and Apparatus for Operating a Secure Metering Device," of JP Leon;

Application Ser. No. 09/358,802, entitled "Method, Apparatus, and Code for Maintaining Secure Postage Data," of J P Leon, Albert L. Pion, and Elizabeth A. Simon;

Application Ser. No. 09/359,163, entitled "Postage Metering System Employing Positional Information," of JP Leon;

Application Ser. No. 09/359,162, entitled "Method and Apparatus for Resetting Postage Meter," of JP Leon; and Application Ser. No. 09/358,511, entitled "Method and Apparatus for Remotely Printing Postage Indicia," of Chandrakant J. Shah, J P Leon, and David A. Coolidge.

BACKGROUND OF THE INVENTION

The present invention relates to the field of postage metering systems, and more particularly to methods and apparatus for authenticating postage labels.

A postage meter allows a user to print postage or other indicia of value on envelopes or other media. Conventionally, the postage meter can be leased or rented from a commercial group (e.g., Neopost Inc.). The user purchases a fixed amount of value beforehand and the meter is programmed with this amount. Subsequently, the user is allowed to print postage up to the programmed amount.

Since the postage meter is able to imprint indicia having values, security is critical to prevent, deter, and detect frauds. In one conventional security scheme, the postage meter is designed to allow imprint of an indicium only when sufficient funds exist to cover the requested indicium amount. If the postage meter is tampered with, it ceases to function and can only be reactivated by an authorized agent. This scheme guards against fraudulent modification of the meter to print unauthorized postage labels.

Postage labels can also be fraudulently generated by other means. For example, unauthorized labels can be reproduced from a label that is legitimately created. Also, devices can be designed to generate counterfeit labels in a manner similar to, for example, counterfeit currencies.

As can be seen, methods and apparatus that deter fraudulent production and reproduction of postage labels, facilitate authentication of legitimate labels, and improve detection of unauthorized labels are highly desirable.

SUMMARY OF THE INVENTION

The invention provides techniques for producing postage labels that include enhanced security features. The postage labels embody generated indicia and can be designed to include various features and to exhibit various characteristics. The indicia can, for example, be printed on preprinted labels or directly onto mail pieces, be formatted using a modular design, include various data fields, be printed with different types of ink that may include taggants, be encoded or signed using encryption keys, and include micro printing and identifiers. The contents of the indicia can include human-readable and machine-readable data elements. Human-readable information includes texts and graphics (e.g., date, address, postage amount, and so on) that can be interpreted by an operator without the use of special translation equipment. Machine-readable information includes graphical representations and encoded texts (e.g., bar codes, FIM marks, data matrix, encoded texts, specially formatted texts, unintelligible texts, and others) that are not readily interpreted by the operator. The postage labels can also include identifier information that exhibits special characteristics and that can be used for authenticating the indicia. The identifiers include, for example, fluorescent strips, marks such as watermarks, micro printing, imprints using special ink and/or taggants, and other features, as described below. The identifier information assists in the prevention and detection of fraud, again as described below.

An embodiment of the invention provides a postage metering system that includes a secure metering device (SMD) coupled to a printer. The SMD generates an indicium and the printer receives and prints the indicium onto a label. The printed indicium label includes a human-readable portion, a machine-readable portion, and an identifier portion. The human-readable portion includes at least one data element, with each data element providing a particular item of postage information. The machine-readable portion includes a combination of one or more graphical representations and encoded texts. The identifier portion exhibits characteristics useful for authenticating the indicium label and can include a fluorescent strip, a micro printing portion, taggants, other identifiers, or a combination thereof.

Another embodiment of the invention provides an article of manufacturer for use as a postage label. The label includes a human-readable portion, a machine-readable portion, and an identifier portion. These portions have similar characteristics as that described above.

Yet another embodiment of the invention provides a postage label authentication system that includes a computer coupled to a data reader, a symbology reader, and a marking reader. The data and symbology readers detect a human-readable and a machine-readable portion, respectively, in a postage label. The marking reader detects one or more identifiers in an identifier portion of the postage label. The computer receives information from the readers and provides a status signal that indicates whether the postage label is authentic.

The foregoing, together with other aspects of this invention, will become more apparent when referring to the following specification, claims, and accompanying drawings.

DESCRIPTION OF THE SPECIFIC EMBODIMENTS

Figure 1A:
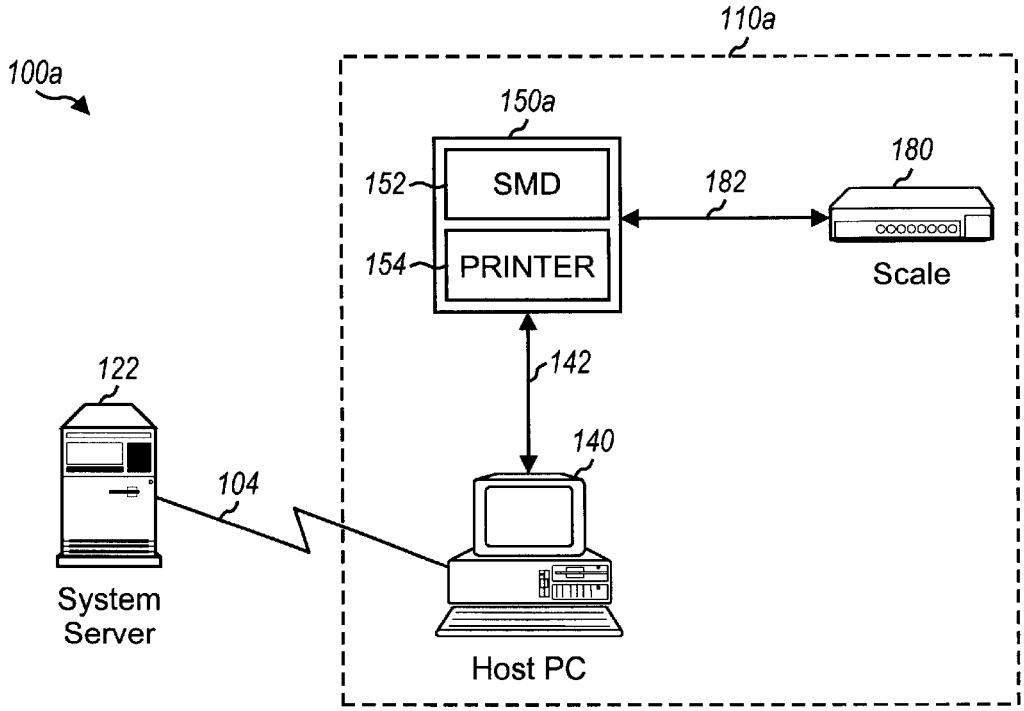
FIGS. 1A through 1C show diagrams of three embodiments of a postage metering system.

FIG. 1A shows a diagram of an embodiment of a postal system 100*a*. Postal system 100*a* includes a postage metering system 110*a* coupled to a system server 122. Metering system 110*a* includes a postage metering device 150*a* coupled to a host personal computer (host PC) 140 via a communications link 142. Host PC further couples to system server 122 (also referred to as a Postage-On-Call™ system or POC system in a specific implementation) via a communications link 104. Metering device 150*a* can further couple to an (optional) scale 180, or other peripheral devices, via a communications link 182. In this embodiment, metering device 150*a* includes a secure metering device (SMD) 152 and a printer 154. The operation of each element in postal system 100*a* is further described in the aforementioned application Ser. No. 09/250,990.

Figure 1B:
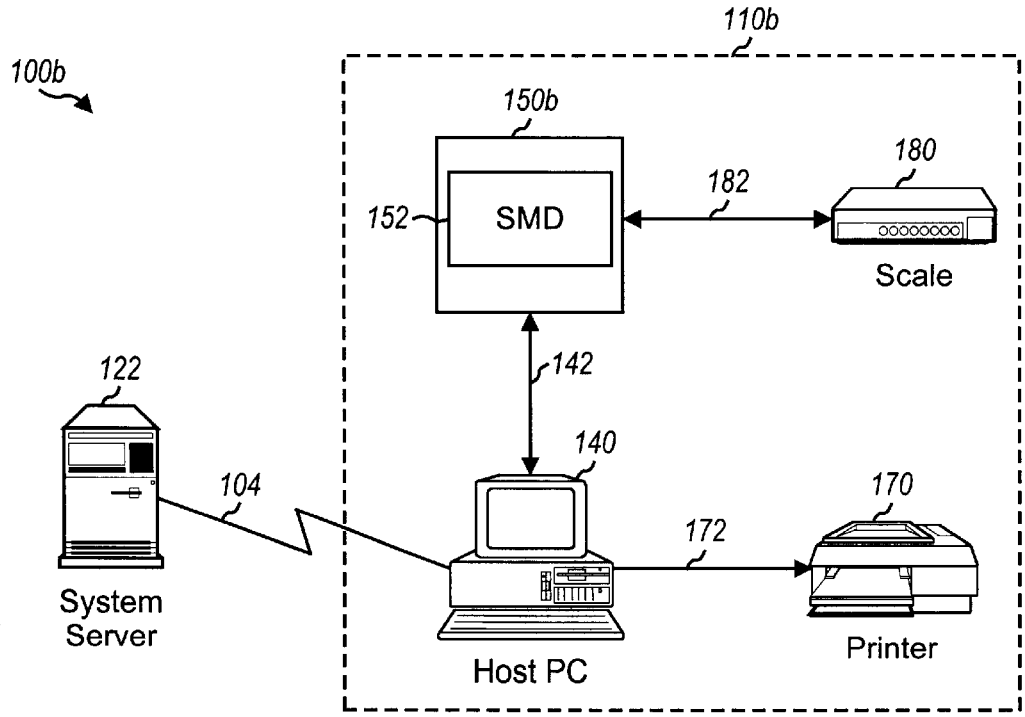

FIG. 1B shows a diagram of an embodiment of another postal system 100*b*. Postal system 100*b* is similar to postal system 100*a* in FIG. 1A, and includes a postage metering system 110*b* coupled to system server 122. Metering system 110*b* includes a postage metering device 150*b* coupled to host PC 140 via communications link 142 and to (optional) scale 180 via communications link 182. Host PC 140 further couples to system server 122 via communications link 104 and to a printer 170 via a communications link 172. In this embodiment, metering device 150*b* includes SMD 152 but no printer.

Figure 1C:
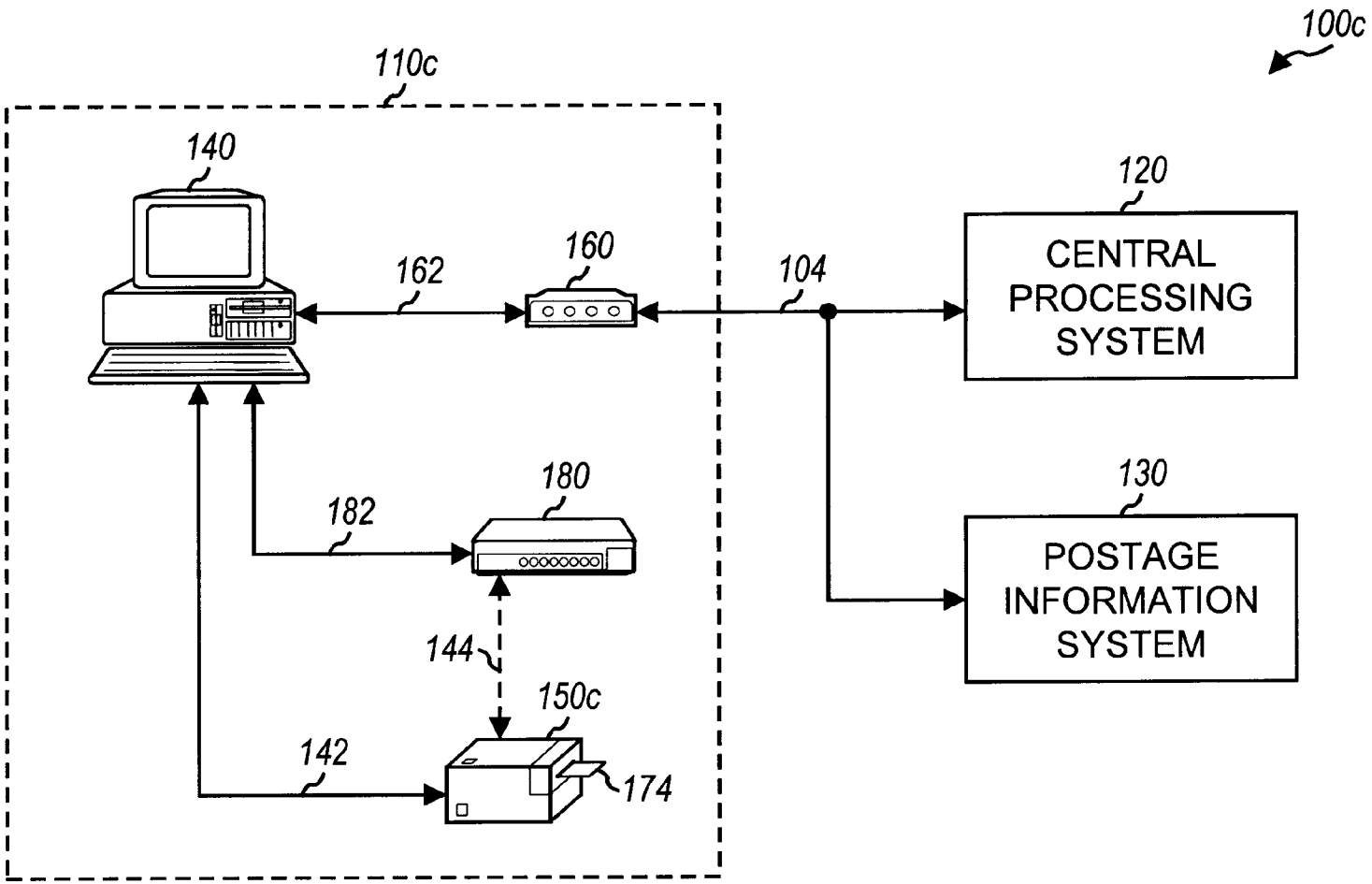

FIG. 1C shows a diagram of an embodiment of yet another postal system 100*c*. Postal system 100*c* includes a postage metering system 110*c* coupled to a central processing system 120 and a postal information system 130. Metering system 110*c* includes a postage metering device 150*c* coupled to host PC 140 via communications link 142. Host PC 140 further couples to a communications device 160 (e.g., a modem, a transceiver, or others) via a communications link 162 and to (optional) scale 180 via communications link 182. Metering device 150*c* can also (optionally) couple directly to scale 180 via a communications link 144. Similar to metering device 150*a*, metering device 150*c* includes a built-in printer that facilitates printing of postage indicia on labels and envelopes (as exemplified by an indicium label 174).

Through communications device 160, host PC 140 is able to communicate with central processing system 120 and postage information system 130. Host PC 140 and metering device 150 communicate postage information (e.g., registration, funding, and auditing information) with system server 122, which is part of central processing system 120. Postal information system 130 is a commercially available system that provides access to national (and possibly international) postal information such as ZIP codes, rate tables, and other information. Host PC 140 and metering device 150 may communicate with postage information server 130 (i.e., to obtain ZIP code and other information).

Postage metering systems 110*a* through 110*c* are examples of systems capable of printing postage indicia. Other postage metering systems can also be designed to print indicia and are within the scope of the invention.

The communications links (e.g., links 142, 144, 162, 172, and 182) between the host PC and peripheral equipment can be wireline or wireless links. For example, these links can be standard serial or parallel interfaces and may employ any mechanism for transferring information, such as RS-232C serial communications link. These links can also be infrared links. The communications link (i.e., link 104) between the host PC and other systems can also be a wireline link (e.g., telephone, Internet, cable, and others), a wireless link (e.g., terrestrial, satellite, microwave, infrared, and others), or other links. To provide a secure communications link that resists unauthorized interception, data can be encrypted, encoded, or signed before being sent over the link.

Figure 2A:
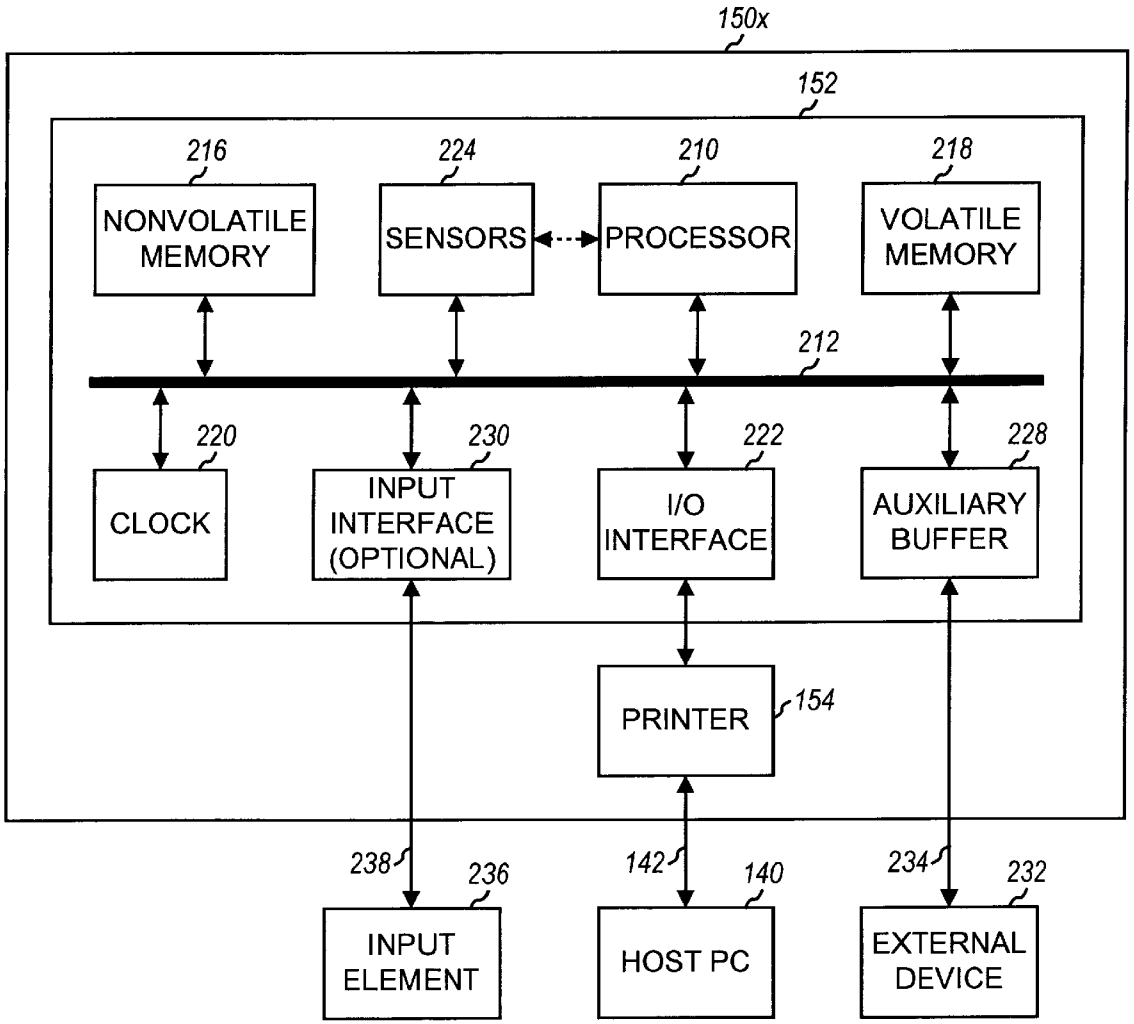
FIG. 2A shows a block diagram of an embodiment of a postage metering device.

FIG. 2A shows a block diagram of a specific embodiment of metering device 150*x*. Metering device 150*x* can be used with any of the systems shown in FIGS. 1A through 1C. In some embodiments, metering device 150*x* is implemented as a dockable or removable device, or both, that attaches to a docking station. Dockable and removable metering devices are described in the aforementioned U.S. patent application Ser. No. 09/359,158.

Metering device 150*x* includes SMD 152 and printer 154. In the specific embodiment shown in FIG. 2A, within SMD 152, a processor 210 couples to a bus 212 that also interconnects a non-volatile memory 216, a volatile memory 218, a clock 220, an I/O interface 222, sensors 224, an auxiliary buffer 228, and an (optional) input interface 230. Auxiliary buffer 228 supports an auxiliary port that couples to an external device 232 (e.g., an electronic scale) via a communications link 234. Auxiliary buffer 228, when enabled, receives and stores data from external device 232. Input interface 230 couples to an input element 236 (e.g., a keypad, buttons, and so on) via a communications link 238.

Processor 210 performs data processing and coordinates communication with the host PC. In an embodiment, processor 210 also performs the secure processing functions for the metering device. Non-volatile memory 216 stores data and codes used by the metering device, such as accounting information and operational information that defines and describes the operation of the metering device. Volatile memory 218 stores data and program instructions. Clock 220 provides indication of current time when requested by the processor.

Sensors 224 can be dispersed throughout metering device 150*x* to detect tampering with the device and to report such event to processor 210. Sensors 224 can couple directly to processor 210 or to bus 212, or a combination of both.

I/O interface 222 couples to printer 154 (for embodiments that include a built-in printer) and further to host PC 140 via communications link 142. In an embodiment, link 142 is a standard interface such as RS-232. I/O interface 222 can be designed to operate on a command set written to reject external print commands, as described in the aforementioned U.S. patent application Ser. No. 09/250,990.

In an embodiment, the SMD is responsible for maintaining the contents of certain security relevant data items (SRDIs). The SRDIs can include revenue or accounting registers, cryptographic keys used for secure data transfer, operational data, and others. In an embodiment, the SMD comprises a cryptographic module that performs the secure processing required by the postage metering system. In an embodiment, the cryptographic module includes processor 210, memories 216 and 218, clock 220, I/O interface 222, and buffer 228. In a specific embodiment, for enhanced security, the cryptographic module is enclosed in a tamper-evident and/or tamper-resistant enclosure, and physical access to elements in the cryptographic module is possible only upon destruction of the enclosure.

Figure 2B:
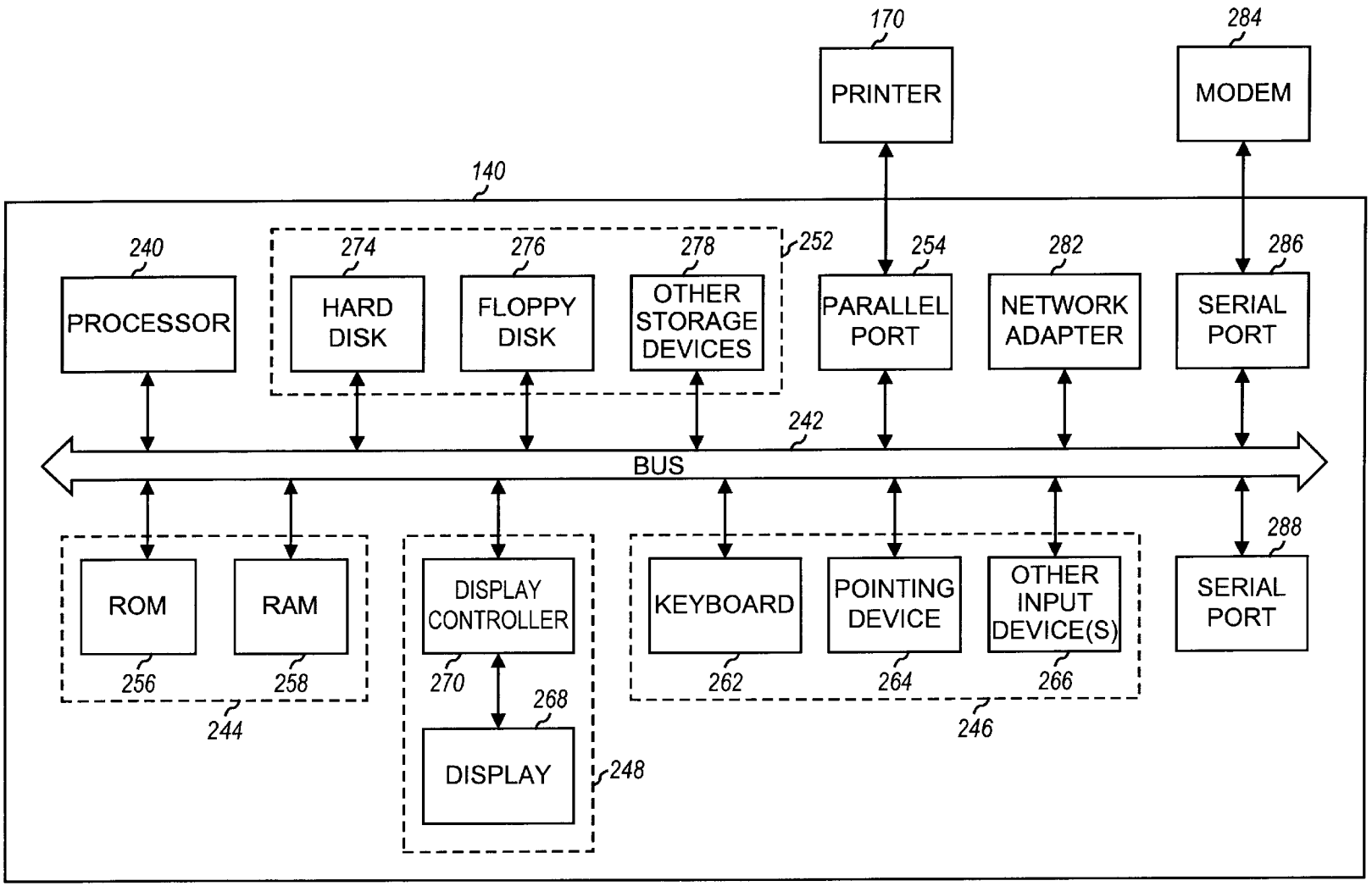
FIG. 2B shows a block diagram of an embodiment of a host PC.

FIG. 2B shows a block diagram of an embodiment of host PC 140. Host PC 140 may be a desktop general-purpose computer system, a portable system, a simplified computer system designed for the specific application described herein, a server, a workstation, a mini-computer, a larger mainframe system, or other computing systems.

As shown in FIG. 2B, host PC 140 includes a processor 240 that communicates with a number of peripheral devices via a bus 242. These peripheral devices typically include a memory subsystem 244, a user input subsystem 246, a display subsystem 248, a file storage system 252, and output devices such as printer 170. Memory subsystem 244 may include a number of memory units, including a non-volatile memory 256 (designated as a ROM) and a volatile memory 258 (designated as a RAM) in which instructions and data may be stored. User input subsystem 246 typically includes a keyboard 262 and may further include a pointing device 264 (e.g., a mouse, a trackball, or the like) and/or other common input device(s) 266. Display subsystem 248 typically includes a display device 268 (e.g., a cathode ray tube (CRT), a liquid crystal display (LCD), or other devices) coupled to a display controller 270. File storage system 252 may include a hard disk 274, a floppy disk 276, other storage devices 278 (such as a CD-ROM drive, a tape drive, or others), or a combination thereof.

Host PC 140 includes a number of I/O devices that facilitate communication with external devices. For example, a parallel port 254 interfaces with printer 170. Network connections are usually established through a device such as a network adapter 282 coupled to bus 242, or a modem 284 via a serial port 286. Host PC 140 can interface with metering device 150 via, for example, parallel port 254 or serial port 286. Other interfaces (e.g., for infrared and wireline devices) can also be provided for host PC 140.

With the exception of the input devices and the display, the other elements need not be located at the same physical site. For example, portions of the file storage system could be coupled via local-area or wide-area network links or telephone lines. Similarly, the input devices and display need not be located at the same site as the processor, although it is anticipated that the present invention will typically be implemented in the context of general-purpose computers and workstations.

Processors 210 and 240 can each be implemented as an application specific integrated circuit (ASIC), a digital signal processor, a microcontroller, a microprocessor, or other electronic units designed to perform the functions described herein. Non-volatile memories 216 and 256 can each be a read only memory (ROM), a FLASH memory, a programmable ROM (PROM), an erasable PROM (EPROM), an electronically erasable PROM (EEPROM), a battery augmented memory (BAM), a battery backed-up RAM (BBRAM), or devices of other memory technologies. Volatile memories 218 and 258 can each be a random access memory (RAM), a FLASH memory, or devices of other memory technologies. Clock 220 is a real-time clock or a secured timer, which is battery backed, to provide accurate time indication even if the metering device is powered down.

As used herein, the term "bus" generically refers to any mechanism for allowing the various elements of the system to communicate with each other. Buses 212 and 242 are each shown as a single bus but may include a number of buses. For example, a system typically has a number of buses such as a local bus and one or more expansion buses (e.g., ADB, SCSI, ISA, EISA, MCA, NuBus, or PCI), as well as serial and parallel ports.

Printers 154 and 170 can be specially designed printers or conventional printers. Printers 154 and 170 are capable of printing human-readable information, machine-readable information, and others. For example, the printers may be directed to print one-dimensional barcodes, two-dimensional barcodes, facing identification mark (FIM) markings, texts, and other graphics. In a specific embodiment, printer 154 is a specially designed printer that is used to print indicia and may be capable of printing other information such as address label, tax stamp, secured ticket, money order, and the like. One such printer is a thermal printer having a resolution of, for example, approximately 200 dots per inch.

Postage metering system 110 performs the functions associated with conventional postage meters, which include accounting, user interface, and indicium generation. In an embodiment, metering device 150 generates postage indicia, directs printing of the indicia (as exemplified by postage label 174 in FIG. 1C), and performs accounting functions generally associated with postage meters.

A specific embodiment of a process for generating an indicium is described in the aforementioned U.S. patent application Ser. No. 09/250,990. In this embodiment, the metering device (or more specifically the SMD) is loaded with funds and the user is allowed to obtain revenue from the SMD in the form of indicia via indicium transactions. An indicium transaction is initiated by a request from the user via the host PC or the metering device. In the metering device/host PC configuration, the host PC sends the SMD a message requesting the SMD to deduct the revenue amount from its revenue registers. If sufficient funds exist, the SMD generates a signed bit pattern representing the revenue (i.e., an indicium) and sends it to the host PC. The host PC then renders the indicium into a particular format and prints it on a document (e.g., a label, a mailpiece, or others). The printed indicium is verifiable (visual) evidence that revenue has been paid.

Figure 3A:
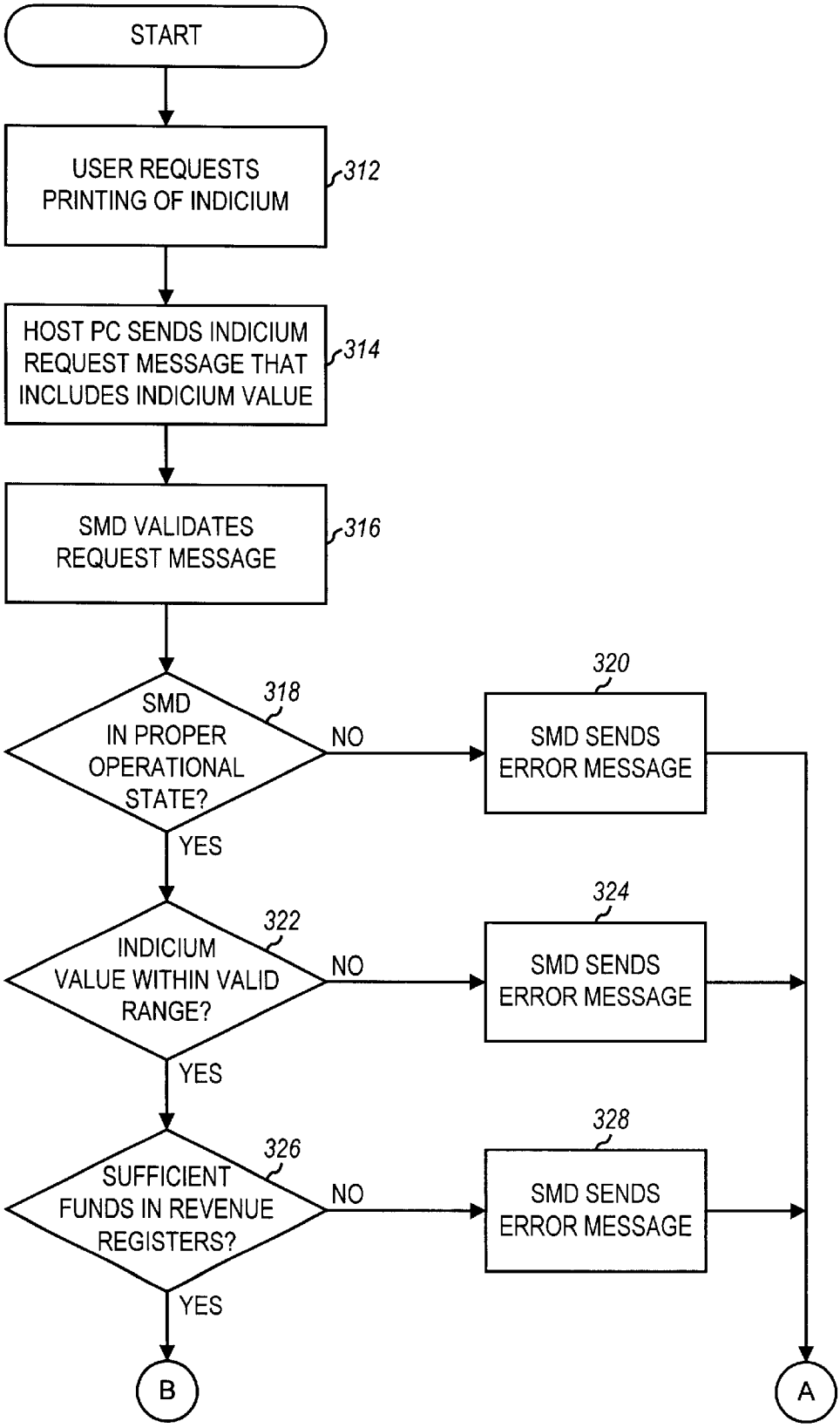
FIGS. 3A and 3B show a flow diagram of an embodiment of an indicium transaction performed by the SMD in conjunction with the host PC.
Figure 3B:
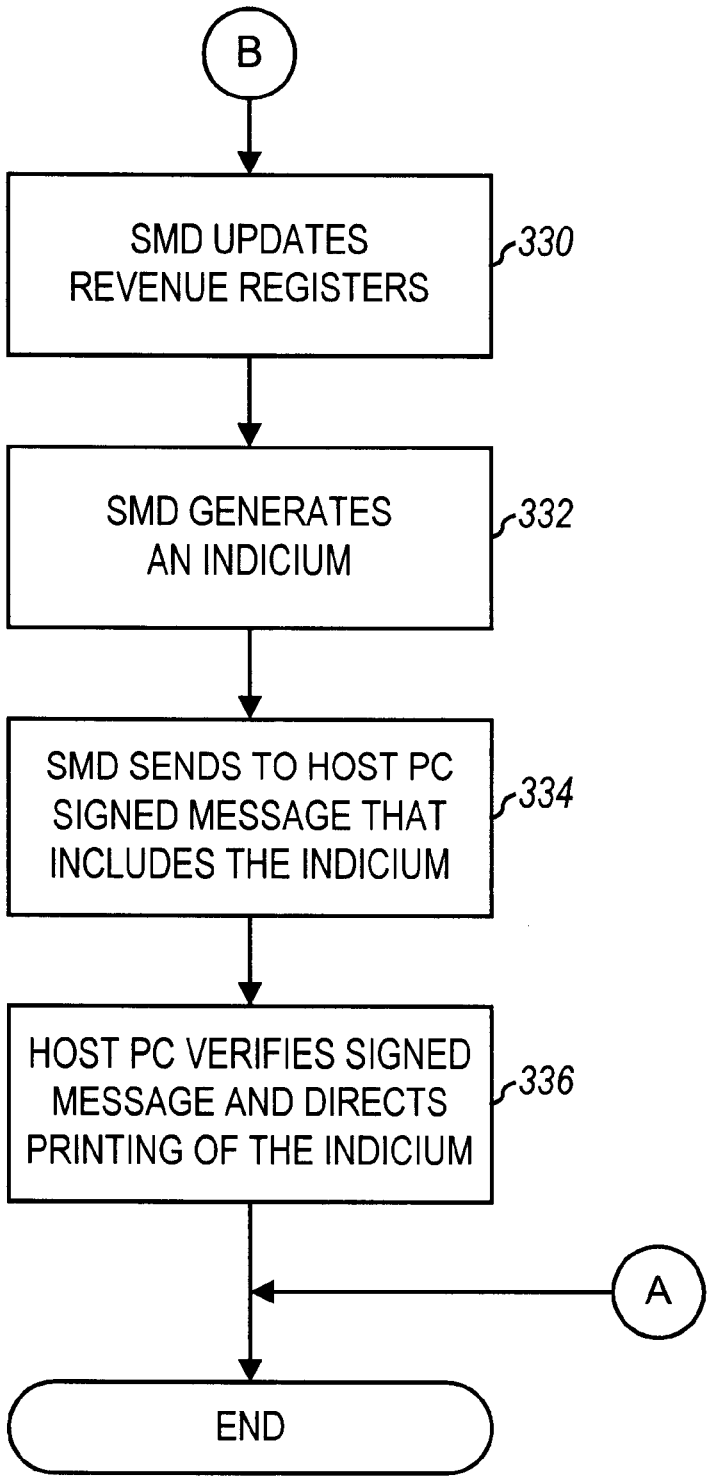

FIGS. 3A and 3B show a flow diagram of an embodiment of an indicium transaction performed by the SMD in conjunction with the host PC. At step 312, the user requests, via the host PC, printing of an indicium. The host PC can provide the user with information such as the funds available in the SMD, the rate tables, address information (e.g., zip code), and others. The user can enter mail parameters such as the class of mail, the zip-code information, and so on. Based on the information entered by the user and additional information (e.g., the mail weight information from a scale coupled to the serial port), the host PC determines the amount of postage for the requested indicium. Alternatively, the user can directly enter the postage amount.

The host PC sends the SMD an indicium request message that includes the requested indicium value, at step 314. In a specific implementation, this request message is not "signed" using a digital signature algorithm, and anyone with access to the host PC can request printing of an indicium. However, safeguards can be provided on the host PC (e.g., through the use of password protection in the host PC software) to prevent unauthorized printing of indicia.

The SMD receives and validates the request message, at step 316. In an embodiment, the SMD accepts a request to perform the indicium transaction if it is operating in a proper operational state (e.g., an Initialized or a Registered state), as determined at step 318. If the SMD receives the request to perform the indicium transaction while it is not in a proper operational state, the SMD sends an error message, at step 320, and the transaction terminates.

Otherwise, the SMD determines whether the requested indicium value is within the minimum and maximum limits, at step 322. If the requested indicium value is outside these limits, the SMD sends an error message, at step 324, and the transaction terminates. Otherwise, the SMD examines its revenue registers to determine whether sufficient funds exist to cover the requested indicium value, at step 326. If the funds are insufficient, the SMD sends an error message, at step 328, and the transaction terminates.

If sufficient funds exist, the SMD updates its revenue registers to account for the requested indicium value, at step 330, and generates an indicium, at step 332. The SMD then generates a message that includes the indicium, signs the message using the SMD's private key, and sends the signed message to the host PC, at step 334.

The host PC verifies the signed message and directs printing of the indicium, at step 336. Alternatively, the indicium can be printed by the built-in printer and the host PC can receive a status message indicating that the indicium has been printed. The host PC may also update the display to reflect the current available funds. Also, if an error message is received during the indicium transaction, the host PC can display the error message to inform the user (e.g., that insufficient funds exist).

In an embodiment, the SMD directs printing of indicia that may be affixed to letters, parcels, and other mail items. The indicia generally comply with the Information Based Indicia Program (IBIP) specifications published by the U.S. Postal Service. The IBIP specifications are described in a document entitled "Information-Based Indicia Program (IBIP) Performance Criteria for Information-Based Indicia and Security Architecture for IBI Postage Metering Systems (PCIBISAIBIPMS)," with a draft date of Aug. 19, 1998, and a document entitled "Information-Based Indicia Program (IBIP) Performance Criteria for Information-Based Indicia and Security Architecture for Closed IBI Postage Metering Systems (PCIBI-C)," with a draft date of Jan. 12, 1999, both of which are incorporated herein by reference in their entirety for all purposes.

The indicia can be designed to include various features and to exhibit various characteristics. The indicia can, for example, be printed on preprinted labels or directly onto mail pieces, be formatted using a modular design, include various data fields, be printed with different types of ink that may include taggants, be encoded or signed using encryption keys, and include micro printing and identifiers. The contents of the indicia can include human-readable and machine-readable data elements. Human-readable information includes texts and graphics (e.g., date, address, postage amount, and so on) that can be interpreted by an operator or auditor without the use of special translation equipment. Machine-readable information includes graphical representations and encoded texts (e.g., bar codes, FIM marks, data matrix, encoded texts, specially formatted texts, unintelligible texts, and others) that are not readily interpreted by the operator or auditor. The postage labels can also include identifier information (i.e., in an identifier portion of the label) that exhibits special characteristics and that can be used for authenticating the indicia. The identifiers include, for example, fluorescent strips, marks such as watermarks, micro printing, imprints using special ink and/or taggants, and other features, as described below. The identifier information assists in the prevention and detection of fraud, again as described below.

For ease of printing and enhanced efficiency, an indicium can be printed on a specially designed, preprinted postage label that is then affixed to the mail piece. The use of a preprinted label can provide many advantages, including enhanced security. The label can be preprinted with any combination of the following features: identifiers, fluorescent markings, micro printing, and others. Generally, these features are designed to be difficult to generate using standard printers (e.g., laser, dot matrix, ink jet, and others) and also difficult to reproduce using conventional techniques (e.g., xerographic reproduction). These features can be preprinted using the enhanced printing capabilities available to a manufacturer. Alternatively or additionally, some of these features can be generated by the printer designated with the task of printing the indicium. Various features that can be included in the preprinted postage label are described below.

The indicia printed by the printer can be altered to meet various objectives and specifications since the indicia are computer generated and the printer is capable of forming images substantially anywhere on the label. The indicia can be defined in many different manners by the system, such as by its constituent parts, by a template that indicates what areas certain types of indicia elements are to appear, by a particular (or minimum) set of indicia elements, and so on. Optional elements (e.g., company logos, and the like) can also be included in the indicia, especially if the indicia include a small set of constituent elements.

For indicia defined by a template, one or more indicium elements can be interchanged to achieve a desired effect. For example, if a particular area of the indicia is defined as including a barcode, that area may be designed to include a one-dimensional barcode, a two-dimensional barcode, cryptographic text, or some other elements.

The ability to modularize, define, and customize the indicia provides many advantages. With this flexibility, a "standard" metering device can be designed and adopted for use, for example, in an international market. In a specific implementation, a list of available elements is formed for the markets targeted for the device. This list can include information such as the postage amount, graphics, time and date of the indicium creation, creation location, and other pertinent information. A template can be created and stored (e.g., in the SMD or the host PC) for each market (e.g., each country). When an indicium is to be generated, the proper template is retrieved based on the (country) information entered by the user or the postage system provider. The retrieved template is then "filled" with relevant information from the element list and from inputs provided by the user. A standard metering device can thus be sold and used in various countries, without special modifications.

The flexibility provided by the modular indicia design also allows the metering device to generate different indicia for different classes of mail. Adjustments can be made to the indicia based on, for example, the characteristics of the mail piece, its country of origin, and the like. The flexibility further allows for easy configuration of the indicia to meet current and future indicia element requirements.

Elements in the indicia can be printed using various types of ink including visible and invisible inks, fluorescent and non-fluorescent inks, or any combination thereof. The ink used for some or all elements can be visible to the human eye. The ink can also be invisible to the human eye under white light (or daylight) and become apparent only under light of specified wavelength(s) such as UV light. For example, ink can be used that renders the printed materials invisible under normal light, but would fluoresce blue under certain non-visible forms of light for instance, UV light. Detection devices can be used to detect the existence and contents of the printed materials, i.e., to authenticate the indicia.

The special ink can be manifested on the indicium label in various ways. For example, parts of the preprinted information on the label can be printed with ink that is visible under normal light. These parts would fluoresce, for example, under UV light. Fluorescent and non-fluorescent inks can have identical appearance under normal lighting and can be used in combination to produce patterns that alter radically when viewed under UV light. As another example, the fluorescent and non-fluorescent inks can be non-pigmented, making them nearly invisible under normal light. Under UV light, the materials printed with these inks can glow and stand out, again radically changing the appearance of the label. Under normal lighting conditions, the imprints can be viewed in similar ways as watermarks, but are typically not conspicuous.

In an embodiment, taggants can be added to the ink to provide enhanced security. Taggants are microscopic identifiers (or beads) that can be mixed into the ink (e.g., fluorescent, conventional, or other types of ink), and are not easily detected. Taggants can be included in the ink used by the printer that prints indicia, such as the built-in printer within the metering device, or the ink used to print the preprinted label, or both. Taggants can also be added to the adhesive (i.e., glue) and/or the paper used for the indicium label. Generally, taggants can be added to any and all parts of the indicium.

Taggants can be manufactured specially for a particular postage service provider, and can be used to uniquely identify that provider. Thus, even if the ink and its fluorescent identifier are duplicated, the presence of taggants allows for analysis of an indicium to determine whether it originates from an authorized metering device. Taggants can be used to discourage counterfeits, and are especially effective because of their unsuspecting nature.

In one specific embodiment, taggant beads are manufactured with multi-colored layers that are visible, for example, under a microscope. The color layers can be arranged in patterns to encode information such as a manufacturer's name, a batch number, or other information. For example, each manufacturer can be assigned a unique color pattern that identifies that manufacturer.

In another specific embodiment, taggant beads are manufactured to contain, for example, aluminum particles. The aluminum particles exhibit electrical properties that cause them to resonate when placed, for example, in a particular radio frequency (RF) field. The frequency of resonance can be used to encode information such as the identity of the manufacturer. The resonance can be detected using a detection device.

With taggants mixed into the ink, the postal authority can perform automated inspection of one or more features that include the taggants. Taggants allow for quick and certain identification of authentic postage labels. Taggants improve the security of the label and thus the indicia.

The specialty (e.g., fluorescent) ink and some types of taggants may require special printing capabilities not available on standard printers or other printers designated with the task of printing indicia. In such situations, the features can be preprinted on postage labels upon which indicia are printed.

The postage label can be imprinted with one or more micro printing portions. Each micro printing portion includes, for example, texts printed in small size fonts or miniature graphics that are difficult to detect and reproduce (i.e., using conventional printers). The micro printing portions are, in many instances, practically invisible to the human eye, and thus usually escape notice. These portions are typically legible with the use of a magnifying glass or when viewed under a microscope. Detection is especially difficult if the micro printing portion is hidden with a visible pattern, printed along a ruled line, or manifested on the label using other "tricks." Such micro printing would, for example, bleed into a solid line if xerographically copied.

The micro printing portions can be preprinted on the postage label by a manufacturer using a suitable printing process, such as the micro printing process used in the banking industry. The micro printing portions can include information such as, for example, the manufacturer's name, the batch number, or other information. Alternatively or additionally, the printer that imprints the indicia can also print micro printing portions, if the capability exists on the printer.

One or more identifiers can also be preprinted anywhere on the postage label to provide enhanced security for the generated indicia. Each identifier can include one or more elements for the purpose of verifying the authenticity of the postage label created. Each element can have one or more colors, designs, and the like.

In an embodiment, the identifier comprises a strip of fluorescent ink, such as a visible pink/red strip of fluorescent ink used by conventional postal equipment to automatically validate mail. In other embodiments, other types of identifiers can be used that differ in shape, placement, color, or other characteristics from the conventional visible pink/red strip used by the U.S. Postal Service. For example, rather than a strip, a proprietary logo can be designed. The identifier can be recognized by character recognition or mark detection mechanisms that exist in some scanning equipment used by the U.S. Postal Service.

The identifier may be printed using visible or invisible ink, fluorescent or non-fluorescent ink, or any combination thereof. The ink used for the identifier can be visible to the human eye, or can be can be invisible to the human eye and become apparent under light of specified wavelength(s). The ink can also render the identifier invisible under normal light, but would fluoresce, for example, blue under certain non-visible forms of light, for example, UV light.

By printing the identifier (e.g., logo) using a special invisible ink, security can be improved because the shape of the identifier, and even its use, would not be readily apparent to those who may attempt to counterfeit indicia. In addition, the invisible identifier can be combined with the conventional pink/red strip to provide a combination of compatibility with current recognition and validation techniques and enhanced security provided by the use of these identifiers.

The postage label can also be configured to include an identification device that allows for tracking of the label. One such device is a radio frequency identification (RFID) device disclosed in U.S. Pat. No. 5,497,140, entitled "Electronically Powered Postage Stamp or Mailing or Shipping Label Operative with Radio Frequency (RF) Communication," issued Mar. 5, 1996, and incorporated herein by reference. The RFID device includes an integrated circuit transceiver chip that transmits RF identification signals which can be tracked. Other types of identification devices can also be incorporated into the postage label and is within the scope of the invention.

The indicia can include various data fields, with each field including any combination of data elements. Elements having a "Yes" indicated in the "Bar Code Data" column are encoded and included in the bar code portion of the indicia. Elements having a "Yes" indicated in the "Human-Readable Data" column are printed in the human-readable portion of the indicia.

Table 1 also includes the field number information for the data elements, which can be used to reorder the indicium data. For example, to construct the indicium, the data elements can be placed in their proper sequence using their respective field numbers.

TABLE 1

Indicium Data Elements

| Data Elements | Bar Code Data | Human-Readable Data | Length (Bytes) | Field Number | Data Type |
|---|---|---|---|---|---|
| Indicium Version Number | Yes | No | 1 | 1 | Hex |
| Algorithm ID | Yes | No | 1 | 2 | Hex |
| Certificate Serial Number | Yes | No | 4 | 3 | PBCD |
| Device ID | Yes | Yes | 8 | 4 | PBCD |
| Ascending Register | Yes | No | 6 | 5 | PBCD |
| Postage | Yes | Yes | 3 | 6 | PBCD |
| Date of Mailing | Yes | Yes | 4 | 7 | PBCD |
| Originating Address (City, State, Zip Code) | Yes | Yes | — | — | N/A |
| Licensing Zip Code | Yes | No | 6 | 8 | PBCD |
| Software ID | Yes | No | 6 | 9 | PBCD |
| Descending Register | Yes | No | 5 | 10 | PBCD |
| Rate Category | Yes | Yes | 4 | 11 | ASCII |
| Digital Signature | Yes | No | DSA: 40 | 12 | Hex |
| Reserve Field Length | Yes | No | 1 | 13 | Hex |
| Reserve Field Data | Yes | No | Variable 0–255 | 14 | Hex |

Table 1 lists the data elements and their format for a specific embodiment. Greater, fewer, or different data elements from those listed in Table 1 can be included in the indicia. Thus, other tables can be generated and are within the scope of the invention.

One or more fields in the indicium can be encoded with a particular encryption algorithm (e.g., DES, RSA, or a comparable algorithm) or signed using a particular cryptographic or digital signature algorithm (e.g., DSA, RSA, or a comparable algorithm), or both. The encoded or signed information can be converted into a printable binary code of some sort. Examples of printable binary codes include bar codes, data matrix, FIM, PDF-417, or others. Data matrix is efficient because it allows for printing of a relatively large amount of data in a small space. Since the indicium is typically restrained to a particular size, efficient use of the available printing area is advantageous.

Data encoding and digital signature can be performed using the SMD's private key. Subsequent data decoding and/or signature authentication can be performed with the SMD's public key, which may be transmitted with the indicium itself. The use of data encoding and digital signature is further described in detail in the aforementioned U.S. patent application Ser. No. 09/250,990.

The data can also be encoded using other schemes. For example, the data can be printed in a graphical format that is arranged in a unique order, such as a data matrix format. This format has the additional advantage of using a small print area to convey information. This graphical encoding scheme can be combined with cryptographic encoding/digital signature to provide two levels of security. First, decoding the graphical data typically requires a special data detection mechanism, or at least an understanding of the encoding techniques used. Second, even if the printed data is captured and decoded, the underlying data encryption can be used to prevent viewing of any or all data contents. Thus, this authentication system meets the requirement for a secure and accurate means of authenticating postage indicia.

Figure 4:
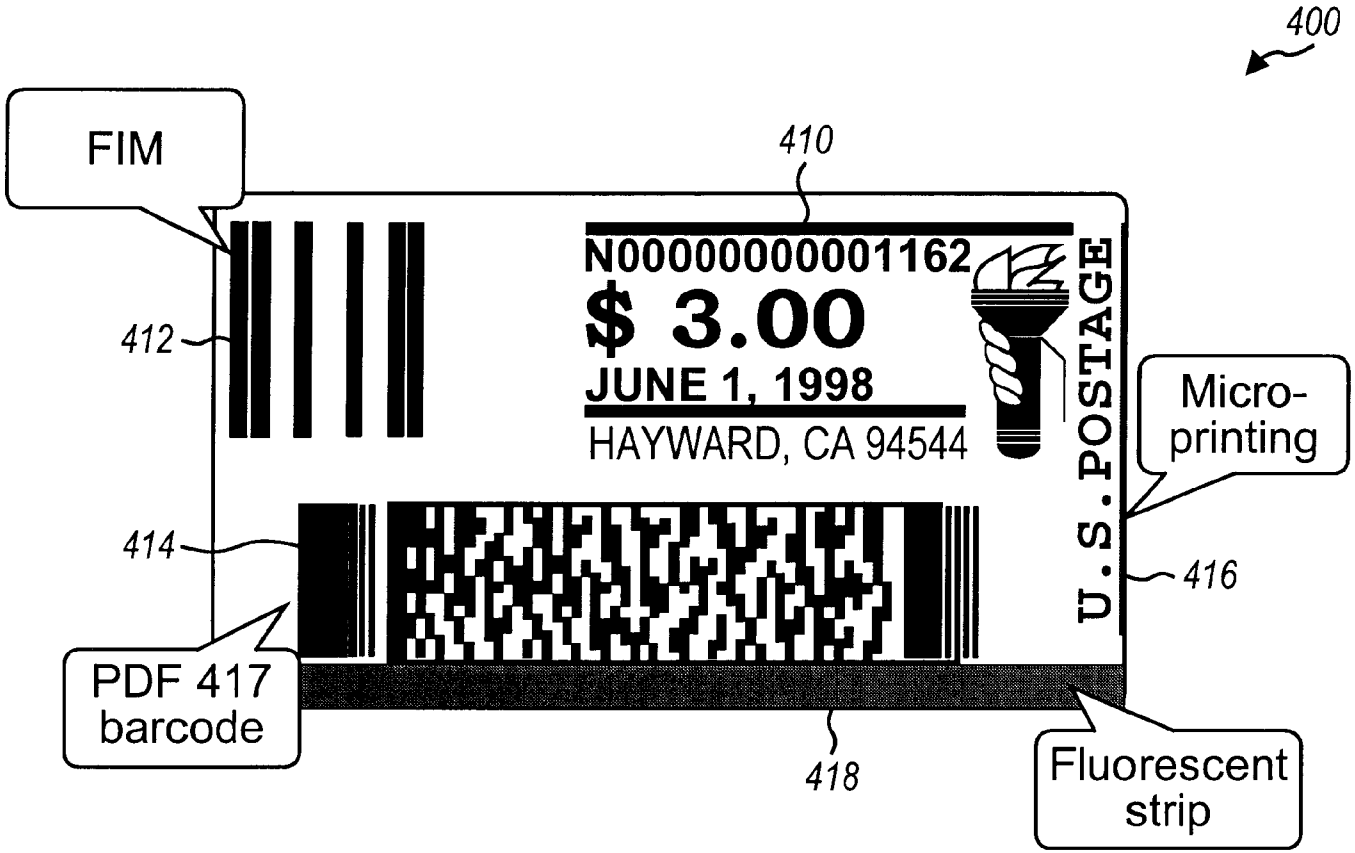
FIG. 4 shows an illustration of a specific embodiment of an indicium.

FIG. 4 shows an illustration of a specific embodiment of an indicium 400. In an embodiment, indicium 400 is printed on a preprinted postage label and includes a human-readable portion 410, a facing identification mark (FIM) marking 412, and a barcode 414. As shown in FIG. 4, human-readable portion 410 includes the device ID number, the postage amount, the date the indicium was printed, the origination address (e.g., the city, state, and zip code), and the rate category. The destination address (e.g., the destination zip code) can also be printed in the human-readable portion of indicium 400, although this is not shown in FIG. 4. The FIM marking and the (e.g., PDF 417) barcode typically conform to IBIP specifications and are used to assist the postal authority in the detection of fraud.

In the specific embodiment shown in FIG. 4, indicium 400 further includes a micro printing portion 416 and a fluorescent identifier (e.g., a stripe) 418 that discourage counterfeits and assist in the their detection.

FIG. 4 shows a specific embodiment of an indicium. The indicium can be designed to include additional, fewer, or different elements than that shown in FIG. 4.

A secure means of authenticating postage indicia is of great importance to the Unites States Post Office, which loses millions (and potentially billions) of dollars a year to the use of fraudulent postage indicia. As described above, the printer imprints postage indicium and other information on the mail piece. As shown in FIG. 4, the postage indicium may include human-readable information and machine-readable information (e.g., encoded/signed data, identifiers, micro printing, and so on). Both forms of information can be used to determine the authenticity of the affixed mark.

Figure 5:
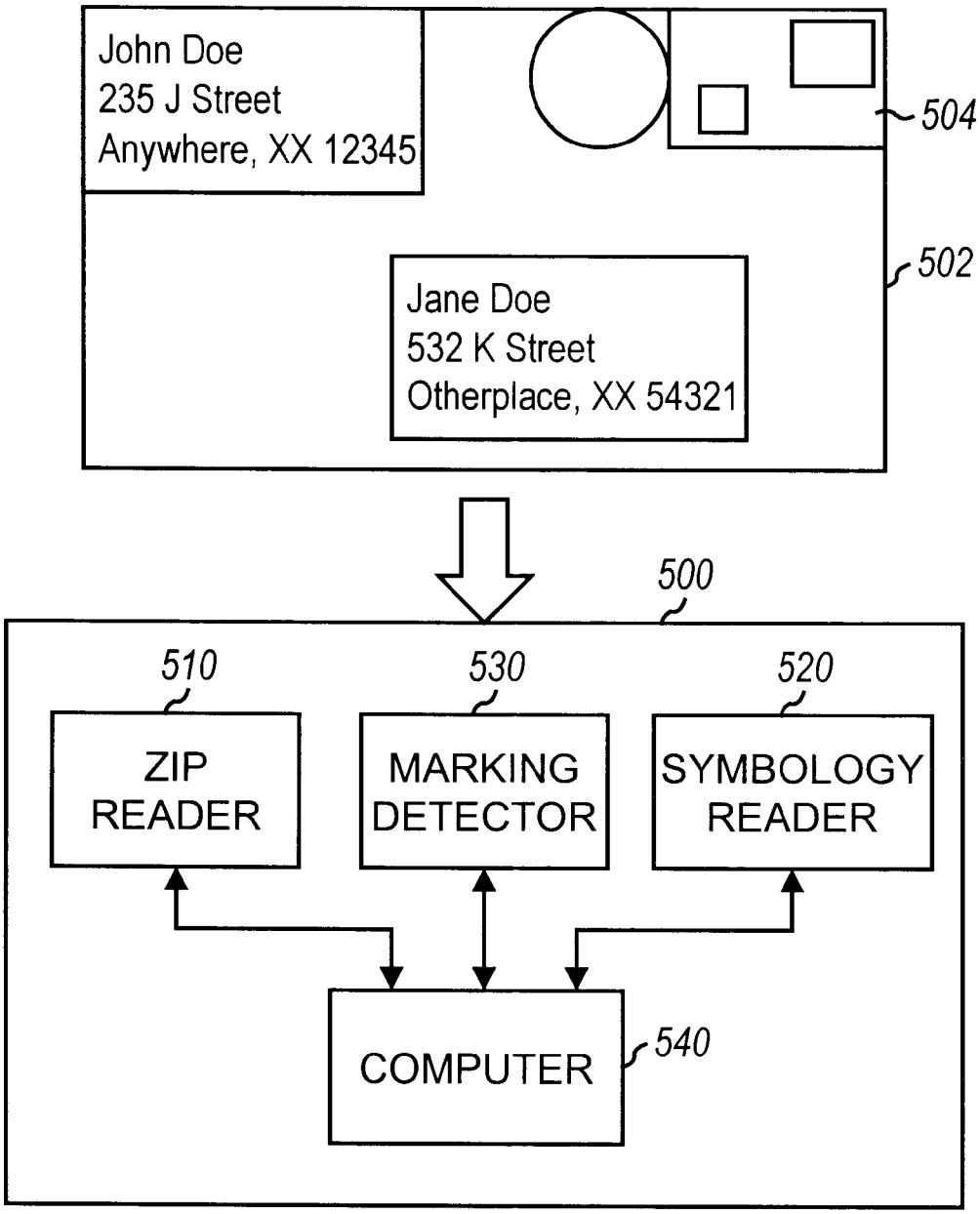
FIG. 5 shows a block diagram of an embodiment of an authentication system for the detection of fraudulent postage indicia.

FIG. 5 shows a block diagram of an embodiment of an authentication system 500 for the detection of fraudulent postage indicia. A mail piece 502 that includes a printed indicium label 504 is provided to the authentication system. Within the authentication system, a data reader 510 reads the human-readable information on the postage label, a symbology reader 520 reads the machine-readable information (e.g., the FIM marking, bar code, and others), and a marking detector 530 detects other imprints that may or may not be visible. The marking detector is designed to detect features not detected by readers 510 and 520. For example, the marking detector can be designed to detect the identifiers and markings printed on the label, the use of invisible and/or fluorescent ink, the micro printing, taggants in the ink, and other features described above.

The information detected by these elements is passed to a computer 540 that analyzes, verifies, and authenticates the information retrieved from the postage label. For example, computer 540 can authenticate a digital signature that is imprinted on the postage label (i.e., using the SMD's public key that is provided in, and detected from the postage label). Computer 540 may also authenticate the postage information by comparing the decoded data with the unencoded data from the postage label.

A postage label that incorporates some or all of the features described herein provides enhanced security over conventional labels. Some of the features (e.g., such as the UV-simulated features and some taggant features) can be automatically detected and verified. Some other features (e.g., such as the micro printing and some other taggant features) may require additional analysis but can facilitate highly reliable identification of suspect items (i.e., after removal from the normal verification process). The multi-level security scheme provides enhanced security over conventional schemes.

The foregoing description of the preferred embodiments is provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

What is claimed is:

1. A postage metering system comprising:

a computer having a user interface to receive postage information;

a secure metering device (SMD) operatively coupled to the computer via a communications link, the SMD including a processor configured to receive the postage information from the computer, direct generation of a postage indicium, and account for the postage indicium, and a tamper evident enclosure that houses the processor; and a printer coupled to the SMD, the printer configured to receive and print the postage indicium; wherein:

the postage indicium is printed on a specially manufactured postage label having an identifier printed with fluorescent ink that is visible when exposed to light of one or more selected wavelengths;

the postage label includes at least one portion printed with an ink that includes a plurality of taggant beads; and each taggant bead has multicolored layers that are arranged in a color pattern to encode information.

2. The system of claim 1, wherein the postage label includes a micro printing portion.

3. The system of claim 1, wherein the taggant beads are formulated to resonate at a particular frequency.

4. The system of claim 1, wherein the postage indicium includes a human-readable portion and a machine-readable portion.

5. The system of claim 4, wherein the machine-readable portion includes a barcode.

6. The system of claim 4, wherein the machine-readable portion includes a facing identification mark (FIM) mark.

7. The system of claim 1, wherein the postage indicium includes a plurality of data fields, each field including at least one data element from a set of available data elements.

8. The system of claim 1, wherein the postage indicium includes a plurality of data elements.

9. The system of claim 1, wherein the postage indicium includes postage information signed using a digital signature algorithm.

10. The system of claim 1, wherein the postage indicium includes postage information encoded using a cryptographic algorithm.

11. The system of claim 7, wherein the data fields conform to IBIP specifications.

12. A postage metering system comprising:

a secure metering device (SMD) configured to generate a postage indicium; and a printer coupled to the SMD and configured to receive and print the postage indicium onto a postage label, wherein the postage indicium includes a human-readable portion that includes at least one data element, each data element providing a particular item of postage information, a machine-readable portion that includes a combination of one or more graphical representations and encoded texts, and an identifier portion that exhibits characteristics used for authenticating the postage indicium; wherein:

the identifier portion includes a fluorescent strip;

the postage label includes at least one portion printed with an ink that includes a plurality of taggant beads; and the taggant beads have multicolored layers that are arranged in at least one color pattern that is an indicator of postage authentication information.

13. The system of claim 12, wherein the identifier portion includes a micro printing portion.

14. The system of claim 12, wherein the characteristics aid in the detection of counterfeit postage indicium.

15. A postage label having a postage indicium, the postage label comprising:

a human-readable portion that includes at least one data element, each data element providing a particular postage information;

a machine-readable portion that includes a combination of one or more graphical representations and encoded texts; and an identifier portion that exhibits characteristics used for authenticating the postage label, wherein:

the identifier portion includes at least one of the group including a fluorescent strip, a micro printing portion, and an identifier; and the identifier portion is printed with an ink that includes taggant beads.

16. The postage label of claim 15, wherein the identifier portion includes a fluorescent strip.

17. The postage label of claim 15, wherein the identifier portion includes a micro printing portion.

18. The postage label of claim 15, wherein the characteristics aid in the detection of counterfeit postage labels.

19. A postage metering system comprising:

a computer having a user interface to receive postage information;

a secure metering device (SMD) operatively coupled to the computer via a communications link, the SMD including:

a processor configured to receive the postage information from the computer, direct generation of a postage indicium, and account for the postage indicium, and a tamper evident enclosure that houses the processor; and a printer coupled to the SMD, the printer configured to receive and print the postage indicium;

wherein the postage indicium is printed on a specially manufactured label having an identifier, the label includes at least one portion printed with an ink that includes taggant beads formulated to provide an identifying characteristic.

20. The system of claim 19, wherein:

the taggant beads include aluminum particles that are formulated to resonate at a particular resonant frequency; and the resonant frequency provides the identifying characteristic.

21. The system of claim 19, wherein the taggant beads are formulated to provide a color pattern.

22. A postage metering system comprising:

a secure metering device (SMD) configured to generate a postage indicium's; and a printer coupled to the SMD and configured to receive and print the postage indicium's onto a label;

wherein the postage indicium's includes a human-readable portion that includes at least one data element, each data element providing a particular item of postage information, a machine-readable portion that includes a combination of one or more graphical representations and encoded texts, and an identifier portion that exhibits characteristics used for authenticating the postage indicium's;

wherein the identifier portion includes a micro-printing portion and printed with ink that includes taggant beads.

23. The postage metering system of claim 22 wherein the micro printing portion is disposed adjacent to a ruled line.

24. A postage metering system comprising:

a secure metering device (SMD) configured to generate a postage indicium; and a printer coupled to the SMD and configured to receive and print the postage indicium onto a label;

wherein the postage indicium includes a human-readable portion that includes at least one data element, each data element providing a particular item of postage information, a machine-readable portion that includes a combination of one or more graphical representations and encoded texts, and an identifier portion that exhibits characteristics used for authenticating the postage indicium;

wherein the identifier portion is printed with ink that includes taggant beads that are viewable under microscopic magnification.

25. The system of claim 1 wherein:

the ink that includes the taggant beads is the fluorescent ink; and the identifier is printed in the fluorescent ink.

26. The system of claim 1 wherein the taggant beads are viewable under microscopic magnification.

27. The system of claim 2 wherein the micro printing portion is disposed adjacent a ruled line.

28. The system of claim 2 wherein the micro printing portions is printed with the ink that includes the taggant beads.

29. The system of claim 3 wherein the resonant frequency is a radio frequency.

30. The system of claim 16 wherein the identifier portion is the at least one portion printed with the ink that includes the taggant beads.

31. The system of claim 30 wherein the fluorescent strip is printed with the ink that includes the taggant beads.

32. The system of claim 15 wherein the taggant beads are viewable under microscopic magnification.

33. The postage label of claim 15 wherein the taggant beads have multicolored layers that are arranged in at least one color pattern that is an indicator of postage authentication information.

34. The postage label of claim 15 wherein:

the taggant beads include aluminum particles that are formulated to resonate at a particular resonant frequency; and the resonant frequency is an indicator of postage authentication information.

35. The system of claim 20 wherein the resonant frequency is a radio frequency.

36. The system of claim 33 wherein the resonant frequency is a radio frequency.

* * * * *